US009945226B2

(12) United States Patent
Brown et al.

(10) Patent No.: US 9,945,226 B2
(45) Date of Patent: Apr. 17, 2018

(54) DETECTING APPARATUS

(71) Applicant: Geoprober Drilling Limited, Aberdeen (GB)

(72) Inventors: Andrew Brown, Aberdeen (GB); Matthew Taylor, Aberdeen (GB)

(73) Assignee: SPEX CORPORATE HOLDINGS LIMITED (GB)

( * ) Notice: Subject to any disclaimer, the term of this patent is extended or adjusted under 35 U.S.C. 154(b) by 0 days.

(21) Appl. No.: 15/714,098

(22) Filed: Sep. 25, 2017

(65) Prior Publication Data

US 2018/0023386 A1 Jan. 25, 2018

Related U.S. Application Data

(63) Continuation of application No. 15/129,076, filed as application No. PCT/GB2015/050868 on Mar. 24, 2015.

(30) Foreign Application Priority Data

Mar. 24, 2014 (GB) ..... 1405203.9

(51) Int. Cl.

| | |
|---|---|
| ***G01N 27/72*** | (2006.01) |
| ***G01N 27/82*** | (2006.01) |
| ***E21B 47/09*** | (2012.01) |
| *E21B 33/06* | (2006.01) |

(52) U.S. Cl.

CPC ..... *E21B 47/0905* (2013.01); *E21B 33/063* (2013.01)

(58) Field of Classification Search

CPC ..... G01N 27/72; G01N 27/82
USPC ..... 324/220–221
See application file for complete search history.

(56) References Cited

U.S. PATENT DOCUMENTS

| | | | |
|---|---|---|---|
| 3,843,923 | A | 10/1974 | Devries et al. |
| 5,720,345 | A | 2/1998 | Price et al. |
| 6,720,764 | B2 | 4/2004 | Relton et al. |
| 7,260,479 | B2 | 8/2007 | McElhinney |

OTHER PUBLICATIONS

International Search Report for corresponding PCT Application No. PCT/GB2015/050868; dated Aug. 26, 2015.

*Primary Examiner* — Bot Ledynh
(74) *Attorney, Agent, or Firm* — Tarolli, Sundheim, Covell & Tummino LLP

(57) ABSTRACT

The present invention provides an apparatus for locating and positioning oilwell tool joints. This invention is particularly useful when the apparatus is placed near a Blowout Preventer (BOP) because it can be used to make sure that a tool joint is not present between the BOP rams. In some embodiments, the invention makes use of magnetic flux creation and detection by electromagnetic coils while a portion of the riser is magnetically saturated by powerful permanent magnets. Different configurations of the driving and sensing coils are possible so that it is possible to locate the tool joints longitudinally and radially within the apparatus. The apparatus is easily retrofitted to existing risers without altering ongoing operations because it can be opened before installation and closed once installed.

23 Claims, 12 Drawing Sheets

DETECTING APPARATUS

RELATED APPLICATIONS

The present invention is a continuation of U.S. application Ser. No. 15/129,076, filed on Sep. 26, 2016, which is a U.S. National Stage under 35 USC 371 patent application, claiming priority to Serial No. PCT/GB2015/050868, filed on 24 Mar. 2015; which claims priority from 1405203.9, filed 24 Mar. 2014, the entirety of which are incorporated herein by reference.

FIELD OF THE INVENTION

The present invention relates to an apparatus and a method for detecting a mass of material that has a magnetic permeability different to that of the surrounding environment within a tubular.

BACKGROUND TO THE INVENTION

The current practice for shutting a well is to first close the annular BOP so that it grips, and forms a seal with, the drill string. Once a seal is established around the drill string, the drill string can be sheared by the BOP shear rams, and a seal formed across the well.

This procedure is complicated by the presence of tool joints, that is a joint between, for example, multiple sections of drill string. A tool joint presents a mass of material which the BOP shear rams would have difficulty cutting, presenting a potential problem in the way of sealing the well.

The current practice for shutting a well is to first close the annular BOP. The drill string is then pulled until an increase in hook load is detected. This indicates that a tool joint has hit the annular BOP seal and therefore the position of the tool joint is established. After this the tool joint can be positioned so that the BOP shear rams can be deployed.

This process is time consuming and requires judgement from the driller over the position of the tool joint.

Being able to give the driller real time data on the position of tool joints would be a great advantage both in time saving and reliability.

SUMMARY OF THE INVENTION

According to a first aspect of the present invention there is provided an apparatus for detecting a mass of material that has a magnetic permeability different to that of the surrounding environment within a tubular, the apparatus comprising:

at least one primary magnetic field source adapted to be mounted to an external surface of a tubular wall and establish a magnetic field in a portion of the tubular wall, the magnetic field, in use, reducing the magnetic permeability of the tubular wall portion;

at least one secondary magnetic field source adapted to be located externally of the tubular wall portion, the/each secondary magnetic field source being adapted to establish a magnetic field within a throughbore defined by the tubular wall; and at least one sense coil, the/each sense coil being adapted to measure a rate of change of the magnetic field within the tubular throughbore.

In at least one embodiment of the present invention, the apparatus provides a method of detecting movement of a mass of material that has a magnetic permeability different to that of the surrounding environment through a tubular interior by measuring, from the exterior of the tubular, the rate of change of magnetic field as the material passes. By reducing the magnetic permeability of the tubular wall portion, the reluctance of the wall portion is increased. With increased reluctance of the tubular wall portion, more of the magnetic flux will seek out a path of lower reluctance and by bringing the paths through the tubular wall down to a more similar level as the paths through a mass of material that has a magnetic permeability different to that of the surrounding environment within the tubular more magnetic flux will flow through the mass of material in preference to the tubular wall portion (assuming the magnetic permeability of the mass of material is greater than the environmental medium within the tubular). As the mass of material passes through, or near to, the at least one sense coil, the change in magnetic field will be detected by the coil and the mass of material can be located.

There may be a plurality of sense coils. Having multiple sense coils allows the apparatus to eliminate or substantially eliminate noise. The cancellation of noise is achieved by the differencing of the outputs of paired sense coils. If there are some background fluctuations in the magnetic field in the pipe due to outside factors such as temperature or stress for example, then these fluctuations are, generally speaking, approximately constant over the distance of pipe between the sense coils. Each sense coil will pick up these fluctuations giving them some noise signal added to the signal of the magnetic field. If the difference is taken of multiple of these coils then, because the noise signals are substantially the same, the differencing of signals from the sense coils "cancels out noise". A plurality of sense coils can also be used to more accurately position the mass of material as it passes through the tubular throughbore.

In some embodiments, the primary magnetic field source may be adapted to establish a magnetic field within the throughbore defined by the tubular wall. In such an embodiment, the primary and one of said secondary magnetic field sources are the same.

In this and other embodiments, the apparatus may further comprise a plurality of secondary magnetic field sources, each source being adapted to establish a magnetic field within the throughbore defined by the tubular wall. Each additional secondary magnetic field source will provide an additional magnetic field to that created by one of said secondary magnetic field sources or created by the primary magnetic field source within the tubular throughbore.

The primary and/or secondary magnetic field sources may be at least one permanent magnets.

The primary and/or secondary magnetic field sources may be at least one temporary magnets.

The at least one temporary magnet may be an electromagnet.

Particularly, at least one of the secondary magnetic field sources may be a temporary magnet. When used as a secondary magnetic field source, a temporary magnet, such as an electromagnet, can be used to vary the magnetic field present within the tubular. By establishing and/or varying the magnetic field within the tubular, a change is created which can be detected by the sense coils and thereby assist in location of the mass of material.

In a preferred embodiment, the/each primary magnetic field source comprises at least one permanent magnet.

In the most preferred embodiment, the/each primary magnetic field source comprises a first permanent magnet and a second permanent magnet, the first and second permanent magnets arranged to form a magnetic circuit encompassing the tubular wall portion.

In this embodiment, at least one of the secondary magnetic field sources comprises a temporary magnet.

Particularly, the/each temporary magnet may be an electromagnet.

Particularly the/each electromagnet may be in the form of a drive coil.

The/each drive coil may be adapted to provide a variable magnetic field. Providing a drive coil allows stationary objects having a mass of material to be located by the apparatus.

The at least one drive coil may be arranged adjacent the tubular wall portion.

The at least one drive coil may encircle the tubular wall portion.

The at least one drive coil may be arranged around part of the circumference of the tubular wall portion.

The at least one drive coil may be arranged circumferentially around the tubular wall portion.

The at least one sense coil may be arranged adjacent the tubular wall portion.

The at least one sense coil may encircle the tubular wall portion.

The at least one sense coil may be arranged around part of the circumference of the tubular wall portion.

The at least one sense coil may be arranged circumferentially around the tubular wall portion.

Where there is a plurality of sense coils, the/each temporary magnet may be positioned between adjacent sense coils. Providing multiple sense coils (one or more on each side of the drive coil) allows you to detect which side of the temporary magnet the mass of material is. Where the apparatus is used with a riser, and the mass of material is a tool joint in a drill pipe, passing through the riser, the apparatus can be used to determine whether the joint is below or above the apparatus.

The apparatus may comprise a plurality of primary magnetic field sources, each source adapted to establish a magnetic circuit within a different portion of the tubular wall.

In this embodiment, each primary magnetic field source may comprise at least one coil.

In this embodiment, the at least one coil may be a sense coil and or a drive coil.

Where there is a plurality or primary magnetic field sources, at least one primary magnetic field source may comprise a riser wall portion by-pass to allow magnetic flux generated by at least one secondary magnetic field source to bypass the riser wall portion associated with the primary magnetic field source.

In this embodiment, the at least one sense coil may be located within the by-pass such that the magnetic flux generated by the secondary magnetic field source only flows through the sense coil in a single direction.

The apparatus may be configured to measure the self-inductance of the/each drive coil.

The apparatus may comprise at least one element of elevated magnetic permeability configured to channel the magnetic flux created by the/each primary magnetic field source at the outer side of the/each primary magnetic field source. In at least one embodiment of the present invention such an element prevents unnecessary dispersion of the magnetic field created by the/each primary magnetic field source and enhances the signal level.

The apparatus may comprise at least one element of elevated magnetic permeability configured to channel the magnetic flux created by the/each secondary magnetic field source at the outer side of the/each secondary magnetic field source. In at least one embodiment of the present invention such an element prevents unnecessary dispersion of the magnetic field created by the/each secondary magnetic field source and enhances the signal level.

The at least one element of elevated magnetic permeability arranged to channel the magnetic flux created by the/each secondary magnetic field sources may be arranged for creating an increased magnetic flux density at the interface with the tubular and contribute to the tubular magnetic saturation.

Alternatively, the at least one element of elevated magnetic permeability arranged to channel the magnetic flux created by the/each secondary magnetic field sources may be arranged for avoiding magnetic flux produced by the primary magnetic field source to pass from a saturated tubular to the element of elevated magnetic permeability. This may be achieved for example by leaving an air gap between the element of elevated magnetic permeability and the tubular. It can also be achieved by placing a material with high magnetic reluctance between the tubular and the element of elevated magnetic permeability.

The at least one element of elevated magnetic permeability arranged to channel the magnetic flux created by the/each primary and/or secondary magnetic field sources may comprise a laminated material. In at least one embodiment of the present invention a laminated material reduces current losses caused by Eddy currents.

The at least one element of elevated magnetic permeability arranged to channel the magnetic flux created by the/each primary and/or secondary magnetic field sources may comprise a powdered material. In at least one embodiment of the present invention a powdered material reduces current losses caused by Eddy currents.

The apparatus may be configured to be opened and closed. In at least one embodiment of the present invention an apparatus that can be opened and closed can be easily retrofitted onto existing facilities without the need to dismantle the facility in order to install the apparatus around a tubular, such as a riser.

The/each sense coil that encircles the tubular wall portion may be configured to be opened and closed.

The/each sense coil that is arranged circumferentially around the tubular wall portion may be configured to be opened and closed.

The/each drive coil that encircles the tubular wall portion may be configured to be opened and closed.

The/each drive coil that is arranged circumferentially around the tubular wall portion may be configured to be opened and closed.

The apparatus may comprise subsea water tight connectors for opening and closing circumferential coils.

The apparatus may comprise a split housing. In at least one embodiment of the present invention a split housing enables easy retrofit of the apparatus to existing tubular structures.

The split housing may comprise fastening elements. In at least one embodiment of the present invention the fastening elements are useful to keep the split housing in a closed position once the apparatus has been installed.

According to a second aspect of the present invention there is provided a method of detecting a mass of material within a tubular, the method comprising the steps of:

reducing the magnetic permeability of a portion of a tubular wall;

establishing a magnetic field within a tubular throughbore through said portion of the tubular wall; and measuring a rate of change of the magnetic field associated with the presence of a mass of material within the tubular.

The method may further comprise the step of varying the magnetic field within the tubular.

The method may further comprise the step of measuring the rate of change of magnetic field within the tubular at multiple separate locations.

According to a third aspect of the present invention there is provided an apparatus for detecting a mass of material that has a magnetic permeability different to that of the surrounding environment within a tubular, the apparatus comprising:

at least one primary magnetic field source adapted to be mounted to an external surface of a tubular wall and establish a magnetic field in a portion of the tubular wall, the magnetic field, in use, reducing the magnetic permeability of the tubular wall portion;

at least one secondary magnetic field source adapted to be located externally of the tubular wall portion, the secondary magnetic field source being adapted to establish a variable magnetic field within a throughbore defined by the tubular wall portion; and a plurality of sense coils, each sense coil being adapted to measure a rate of change of the magnetic field within the tubular throughbore.

In at least one embodiment of the present invention an apparatus that comprises a plurality of sense coils can be very useful to cancel out noise signals picked up by the various sense coils. Additionally, a plurality of sense coils can also be used to more accurately position the mass of material as it passes through the tubular throughbore, either longitudinally or radially. Another advantage of having a plurality of sense coils is that it is possible to build embodiments which can be easily retrofitted to existing structures, such as risers, without the need to dismantle the structure in order to install an apparatus surrounding the riser.

The apparatus may comprise a plurality of sense coils which cooperatively define at least one circumference.

Each sense coil may be arranged such that it defines a closed area on the tubular wall. The sense coils may adopt many different closed geometric shapes.

Each closed area defined by a sense coil may at least partially overlap at least another closed area defined by another sense coil.

The at least one secondary magnetic source may be a plurality of drive coils.

The plurality of drive coils may cooperatively define at least one circumference.

Each drive coil may be arranged such that it defines a closed area on the tubular wall. The drive coils may adopt many different closed geometric shapes.

Each closed area defined by a drive coil may at least partially overlap at least another closed area defined by another drive and/or sense coil.

The sense coils which cooperatively define a circumference around a tubular may be configured and connected to determine the radial position of the mass within the circumference.

Various combinations and quantities of sense and drive coils are possible.

In the case where several sense and drive coils are present, sense coils located diametrically opposed may be wounded in the opposite sense such that they couple the magnetic field created by the plurality of drive coils.

In the case where several drive coils cooperatively define a circumference, diametrically opposed drive coils may be arranged such that their magnetic fields couple positively (sum) or negatively (subtract) to create a more or less intense magnetic field within the tubular This feature can be used to cause an increased signal when a tool joint is present or a decreased signal when a tool joint is present.

The apparatus may comprise drive electronics to control the drive coils.

The drive electronics may comprise current regulated circuits. Alternatively or additionally the drive electronics may comprise voltage regulated circuits. The drive electronics may comprise open loop circuits. Alternatively or additionally the drive electronics may comprise closed loop circuits.

The drive electronics may be configured to be actuated by a drive signal.

The drive signal may be unipolar.

Alternatively or additionally the drive signal may bipolar. Bipolar signals prevent undesired uni-directional magnetisation of system components.

The drive signal may be a continuous wave, such as sinusoidal or squared signal. Alternatively or additionally the drive signal may be pulsed.

Alternatively or additionally the apparatus may comprise sensing electronics to control the sense coils.

The sensing electronics may comprise a buffer-amplifier for setting appropriate loading of sensing coils.

The sensing electronics may comprise a filter for preferentially selecting the signal from noise background (interference or fundamental physical noise mechanism).

The sensing electronics may comprise an analogue to digital conversion unit. In at least one embodiment of the present invention an analogue to digital conversion unit allows subsequent digital signal processing.

The sensing electronics may be configured to receive information from the drive electronics. In at least one embodiment of the present invention this feature assists in signal extraction, as in the lock-in technique.

In at least one embodiment of the present invention electronic circuits facilitate control of the apparatus function when there are multiple drive and/or sense coils and also facilitate the extraction of information from the apparatus.

Diametrically opposed drive/sense coils may be connected in parallel to the control electronic circuits. Alternatively diametrically opposed drive/sense coils may be connected in series to the control electronic circuits. Alternatively or additionally drive/sense coils may be individually connected to the control electronic circuits.

In some embodiments the offset of the drill pipe or tool joint can be quantified due to increased coupling into one sense coil compared to the corresponding opposite sense coil.

It will be understood that features listed as optional with regard to the first aspect may be equally relevant to the second and subsequent aspects and are not repeated for brevity.

BRIEF DESCRIPTION OF THE DRAWINGS

Embodiments of the present invention will now be described with reference to the accompanying Figures in which:

FIG. 6 is a section through the apparatus of FIG. 4 showing the drive coil switched on;

FIG. 9 is a half section through the apparatus of FIG. 8 showing the drive coil switched on.

DETAILED DESCRIPTION OF THE DRAWINGS

Figure 1:
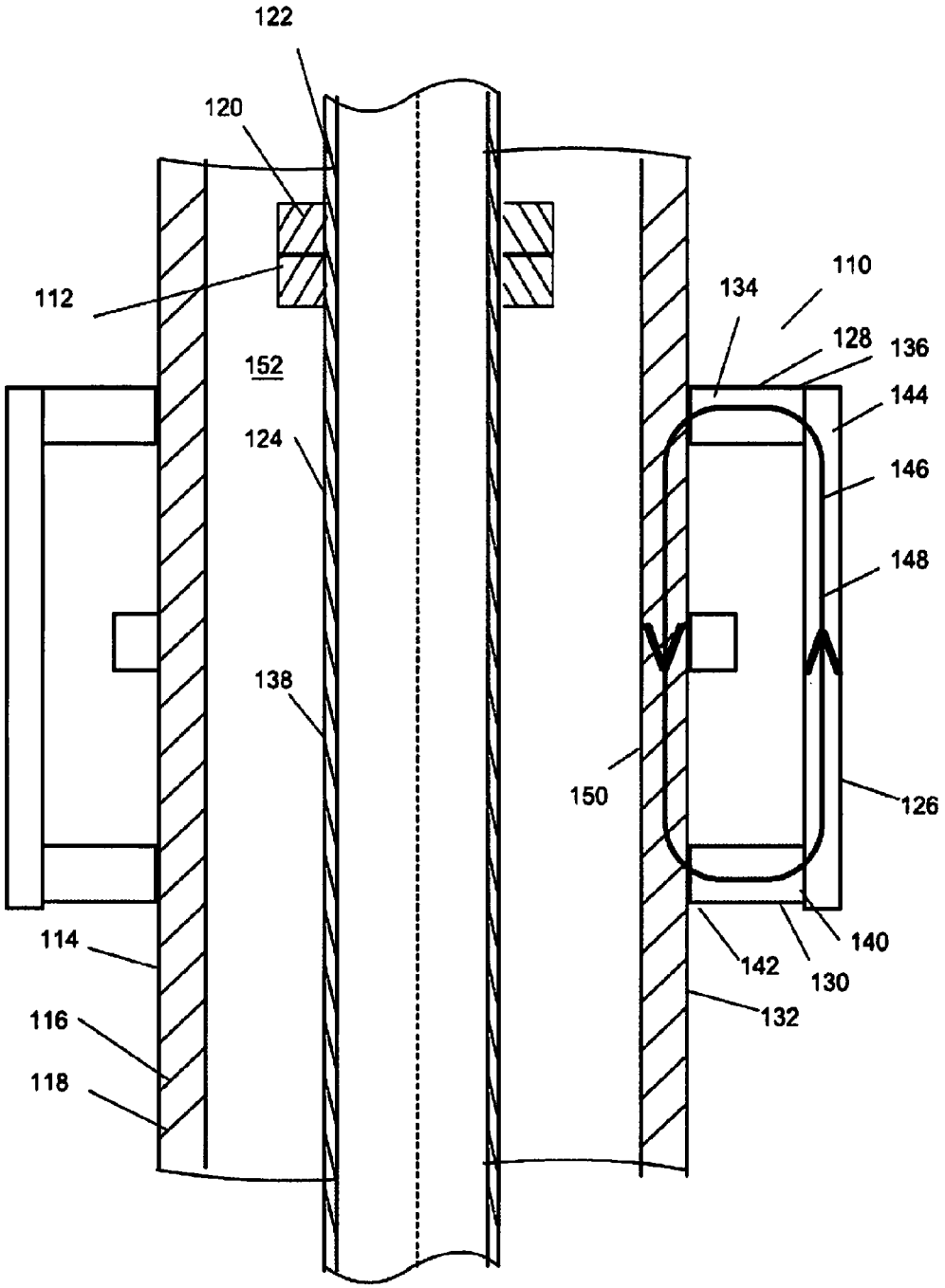
FIG. 1 is a section through an apparatus for detecting a mass of material within the tubular according to a first embodiment of the present invention.

Reference is first made to FIG. 1, a section through an apparatus, generally indicated by reference numeral 110, for detecting a mass of material 112 within a tubular 114 having a tubular wall 116, according to a first embodiment of the present invention. Particularly the tubular 114 is a riser 118, and the mass of material 112 is a drill pipe joint 120 in a drill pipe 138 joining an upper length of drill pipe 122 to a lower length of drill pipe 124.

The apparatus 110 comprises a primary magnetic field source 126, the primary magnetic field source 126 consisting of an upper permanent magnet 128 and a lower permanent magnet 130. Both of the permanent magnets 128, 130 are magnetically attracted to, and positioned on, a riser external surface 132. The upper permanent magnet has a north end 134 and a south end 136, similarly the lower permanent magnet 130 has a north end 140 and a south end 142.

As can be seen from FIG. 1, the upper permanent magnet north end 134 and lower permanent magnet south end 142 are attached to the riser external surface 132, and a plate 144 is connected between the lower permanent magnet north end 140 and the upper permanent magnet south end 136. Such an arrangement creates a magnetic field between the multiple magnets 128,130.

The plate 144 and the riser 118 are made from steel which is a high permeability and low reluctance material. In terms of reluctance, the plate 144 and riser 118 therefore provide preferred paths for the magnetic fields of the upper and lower permanent magnets 128, 130, in comparison to the reluctance provided by the environment surrounding the apparatus. The magnetic fields of the magnets 128,130 are therefore substantially constrained to the magnetic field line 146.

The magnets 128, 130 have sufficient magnetic field strength to reduce the permeability of the riser wall portion 150 to a similar level to the environment surrounding the apparatus 110. Once reduce the permeability of the riser wall portion 150 falls to a similar level to the environment surrounding the apparatus 110, the magnetic fields of the magnets 128,130 look for additional paths.

Figure 2:
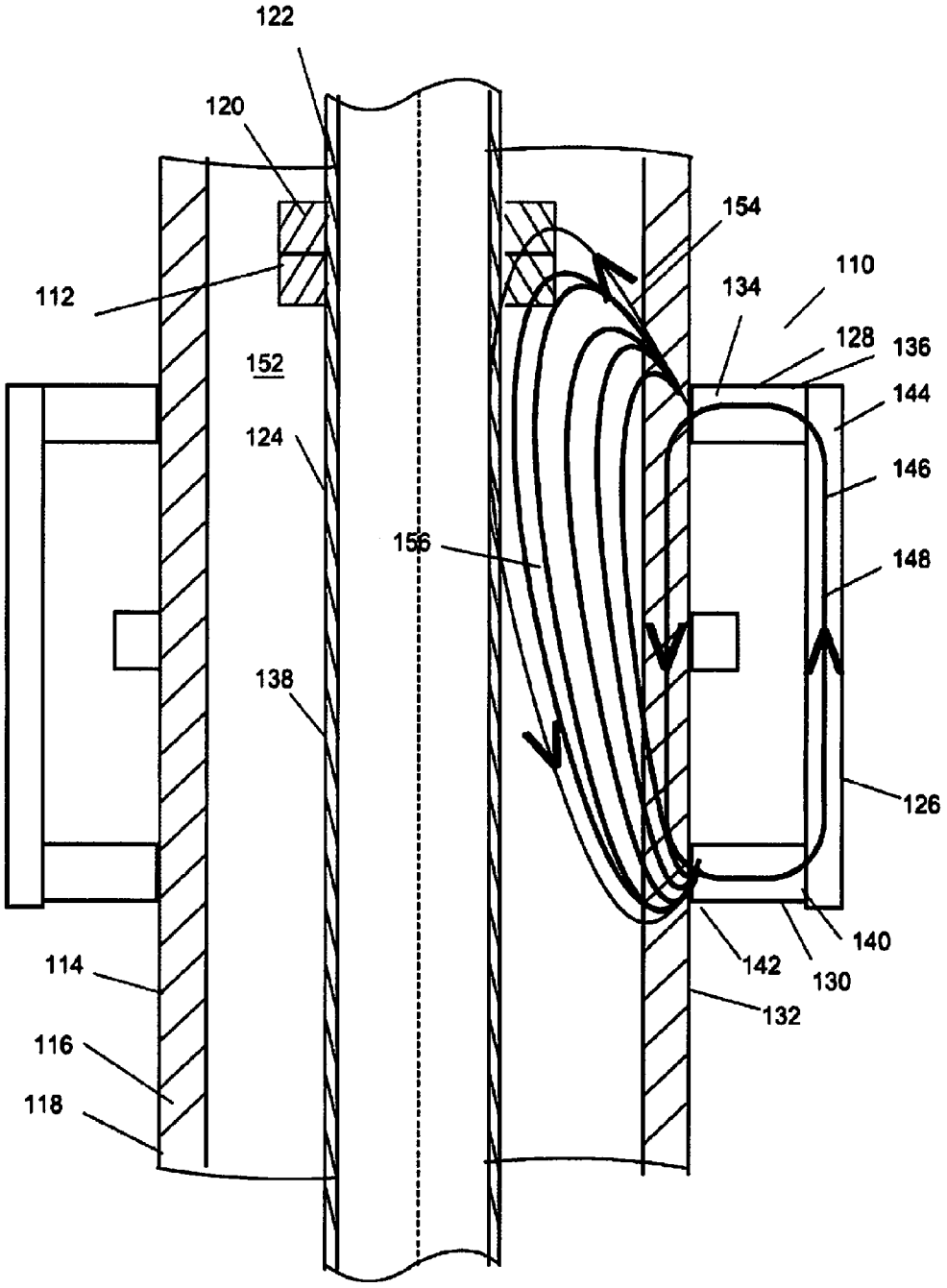
FIG. 2 is a section through the apparatus of FIG. 1 showing the magnetic flux being attracted to the tool joint in a first position.

Referring to FIG. 2, a section through the apparatus 110 of FIG. 1, additional paths for the magnetic fields are provided through the air alone and through the air and the drill pipe joint 120 in a first position, as shown by the magnetic field lines 156, and as will be discussed. The apparatus 110 further comprises a secondary magnetic field source, in this embodiment also the permanent magnets 128, 130, adapted to establish a magnetic field 156 within the riser throughbore 152.

As air also has a high reluctance, the magnetic field 156 will be attracted to the material in the riser 118 as steel has a higher permeability than air. Particularly, the magnetic field 156 is attracted to a material which is magnetically softer than the air within the riser 118. The drill pipe 138 provides a suitable path. Particularly, the magnetic field 156 will be attracted to the mass of material which is the drill pipe joint 120. As shown in FIG. 2, the magnetic field 156 within the riser 118 is distorted by the presence of the tool joint 120.

The apparatus 110 further comprises a sense coil 160. The sense coil 160 is wrapped around the riser external surface 132 and measures the rate of change of the magnetic field 156, the change in magnetic field 156 inducing a current in the coil 160.

Figure 3:
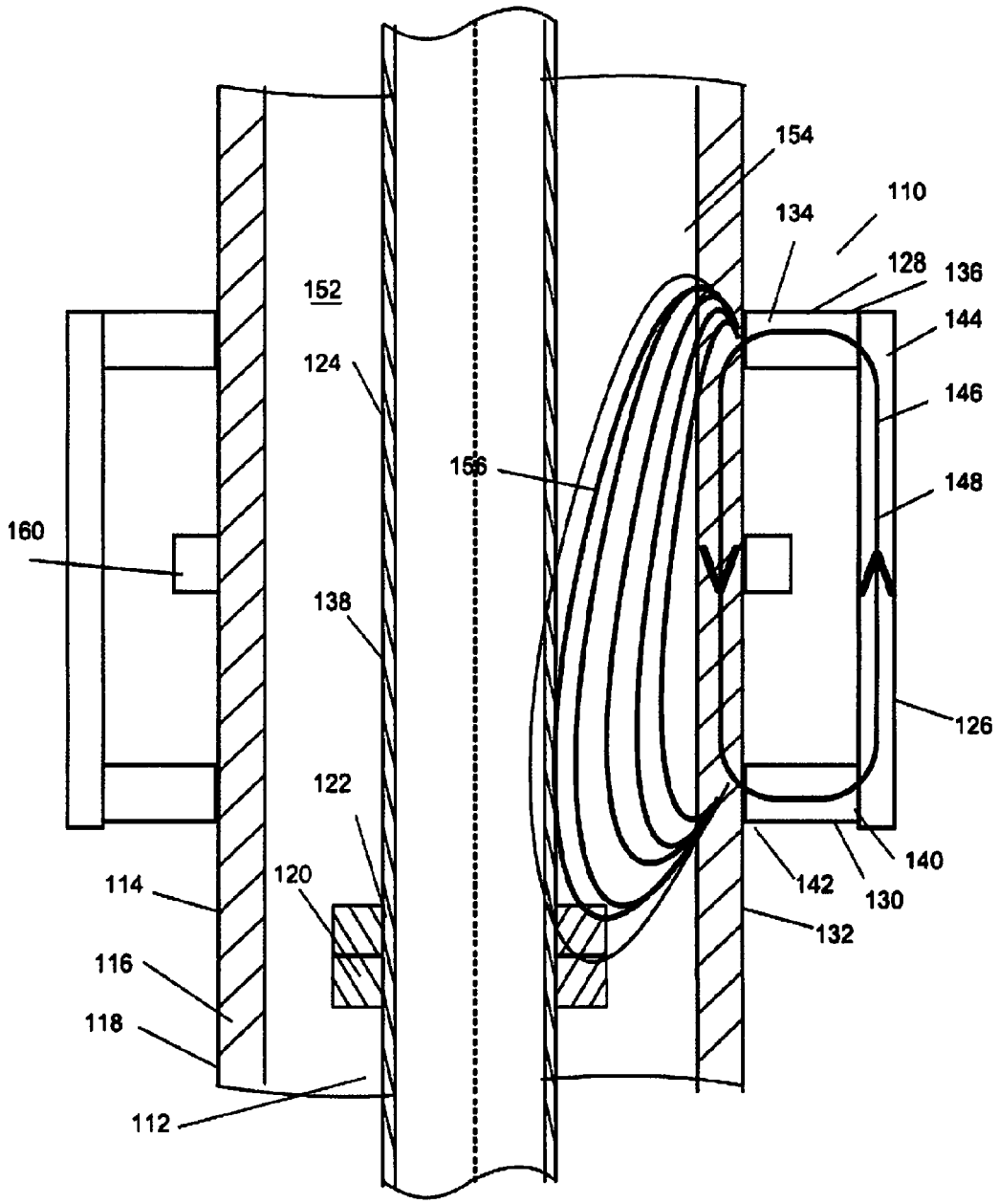
FIG. 3 is a section through the apparatus of FIG. 1 showing the magnetic flux being attracted to the tool joint in a second position.

With the drill pipe 138 stationary there is no change in the magnetic field 156, however if the drill pipe 138 passes through the riser throughbore 152, the drill pipe joint 120 will pass through the sense coil 160 and continue downwards, as shown in FIG. 3, a section through the apparatus 110 of FIG. 1 showing the magnetic field 156 being attracted to the tool joint 120 in a second position. The magnetic field will change as the tool joint 120 moves from the first position to the second position through the sense coil 160. The variation in the intensity of the magnetic field 156 will induce a variation in the current generated in the coil 160, indicating the passage of the tool joint 120 through the apparatus 110.

Figure 4:
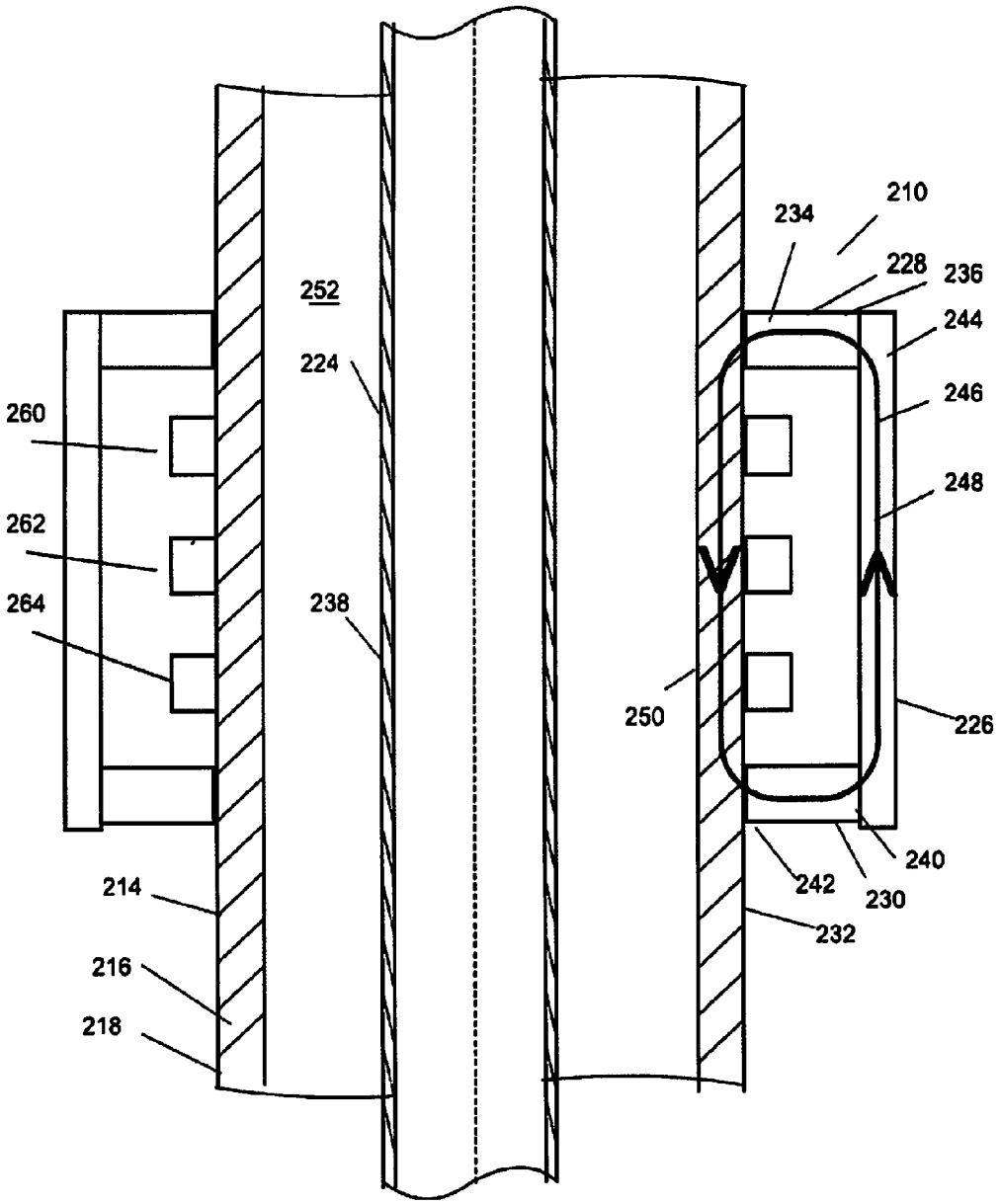
FIG. 4 is a section through an apparatus, for detecting a mass of material within a tubular according to a second embodiment of the present invention.

Reference is now made to FIG. 4, a section through an apparatus 210, for detecting a mass of material within a tubular 214 having a tubular wall 216, according to a second embodiment of the present invention. The apparatus 210 of this second embodiment is very similar to the apparatus 110 of the first embodiment. Common features between the first and second embodiment have been given the same reference numeral in the second embodiment section, incremented by 100.

The essential difference between the first embodiment apparatus 110 and the second embodiment apparatus 210 is the inclusion of two additional coils 262, 264. The apparatus 210, therefore, comprises three coils 260, 262, 264. The middle coil 262 is a drive coil, adapted to conduct electricity supplied by a power source (not shown) and create a magnetic field within the riser 218. This additional secondary source of a magnetic field 262 can be used in addition to the magnetic field generated within the tubular through bore 252 by the primary magnetic field source 226. This arrangement allows stationary objects to be identified and their approximate position obtained, as will now be explained.

Figure 5:
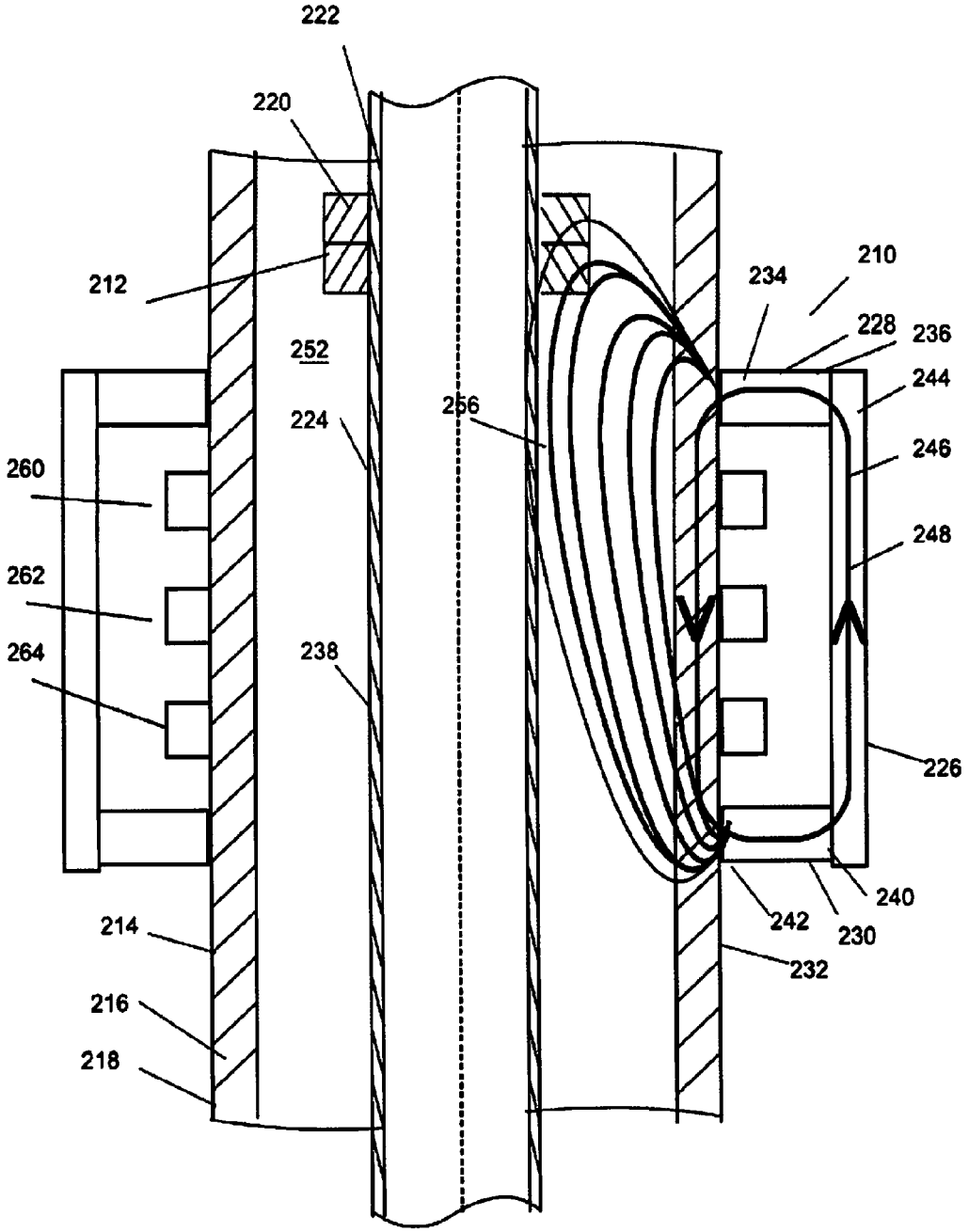
FIG. 5 is a section through the apparatus of FIG. 4 showing magnetic flux being attracted to a tool joint in a first position.

Reference is made to FIG. 5, a section through the apparatus 210 of FIG. 4 showing a magnetic field 256 being attracted to a drill pipe joint 220 in a first position. The magnetic field 256 is generated by the primary magnetic field source 226, the magnetic field 256 looking for additional paths through the riser 218 after the saturation of the riser wall portion 250. As before, the magnetic field 256 is attracted to the drill pipe joint 220.

Figure 6:
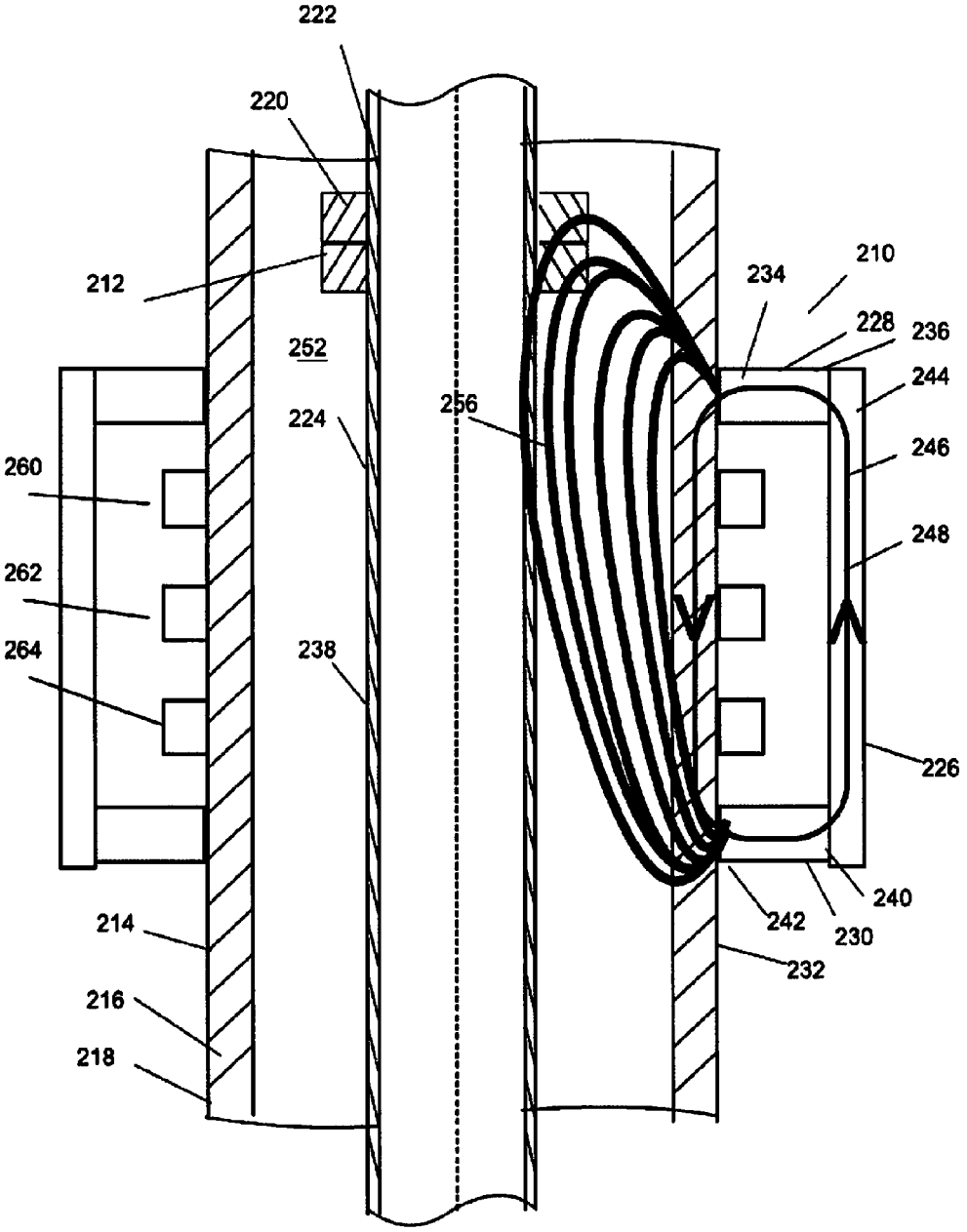

The drive coil 262 is then pulsed by passing electricity through it in pulses. Referring to FIG. 6, a section through the apparatus of FIG. 4 showing the drive coil 262 switched on, pulsing the drive coil 262 establishes a second magnetic field 270 which is also drawn towards the drill pipe joint 220. By switching the drive coil 262 off and on, a rate of change of the total magnetic field 256, 270 can be determined by both the current induced in the upper sense coil 260 and the lower sense coil 264. By comparing the current induced in each coil 260, 264, the approximate position of the drill pipe joint 220 can be located.

Figure 7:
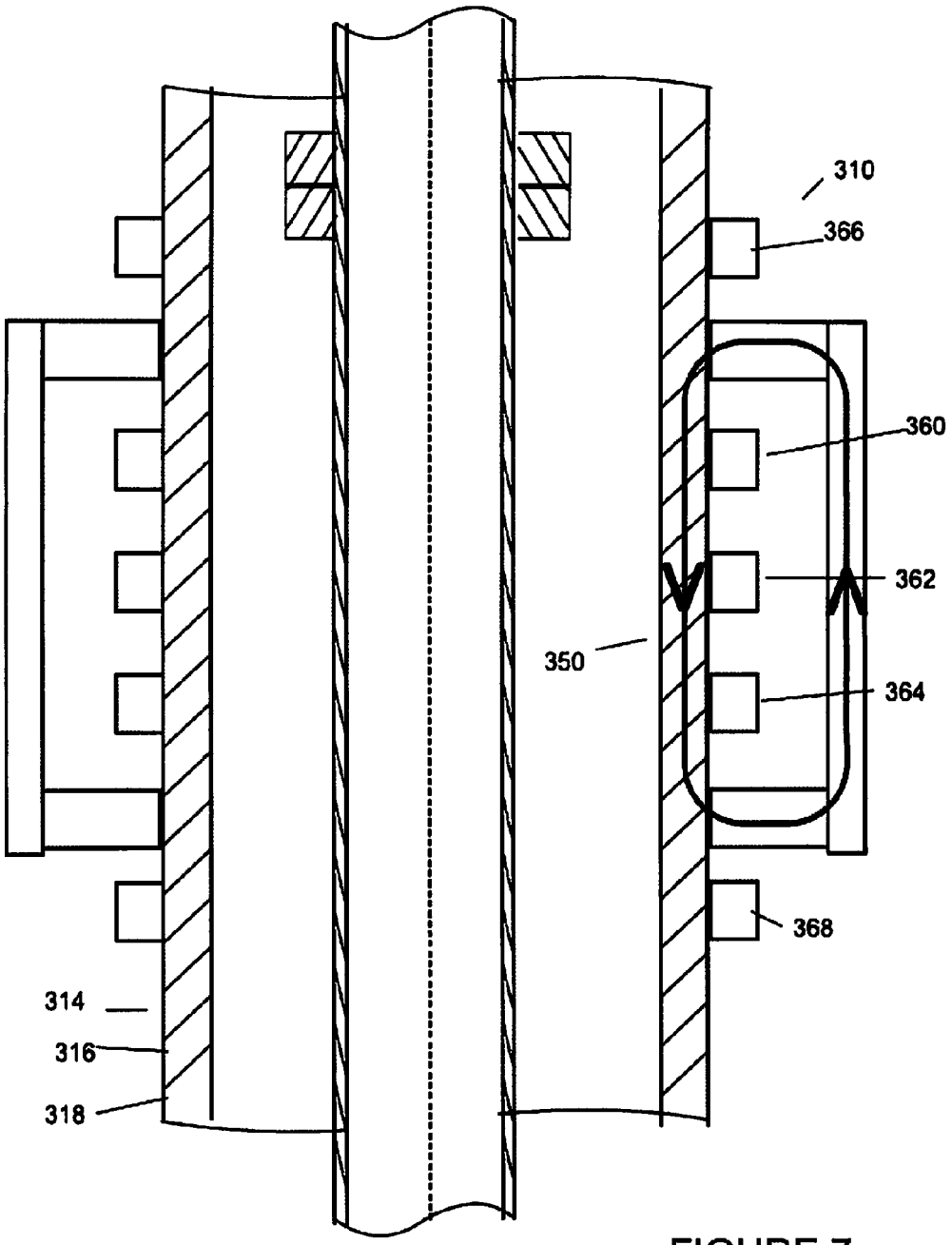
FIG. 7 is a section through an apparatus for detecting a mass of material within a tubular according to a third embodiment of the present invention.

Referring now to FIG. 7, a section through an apparatus 310 for detecting a mass of material within a tubular 314 having a tubular wall 316, according to a third embodiment of the present invention. Again, common features between the first and third embodiments have been given the same reference numeral in the third embodiment, incremented by 200.

The apparatus 310 has two further coils 366, 368. It will be noted that these coils are out with the magnetic field 346 established within the riser wall portion 350. As this portion of the wall 316 is not saturated, these coils 366, 368 can only be sense coils as a drive coil would be unable to establish a magnetic field through the unsaturated wall 316 without extremely high levels of power being provided to it.

These additional sense coils 366, 368 provide additional information on the position of the drill pipe joint 320 as the drive coil 362 is pulsed.

Figure 8:
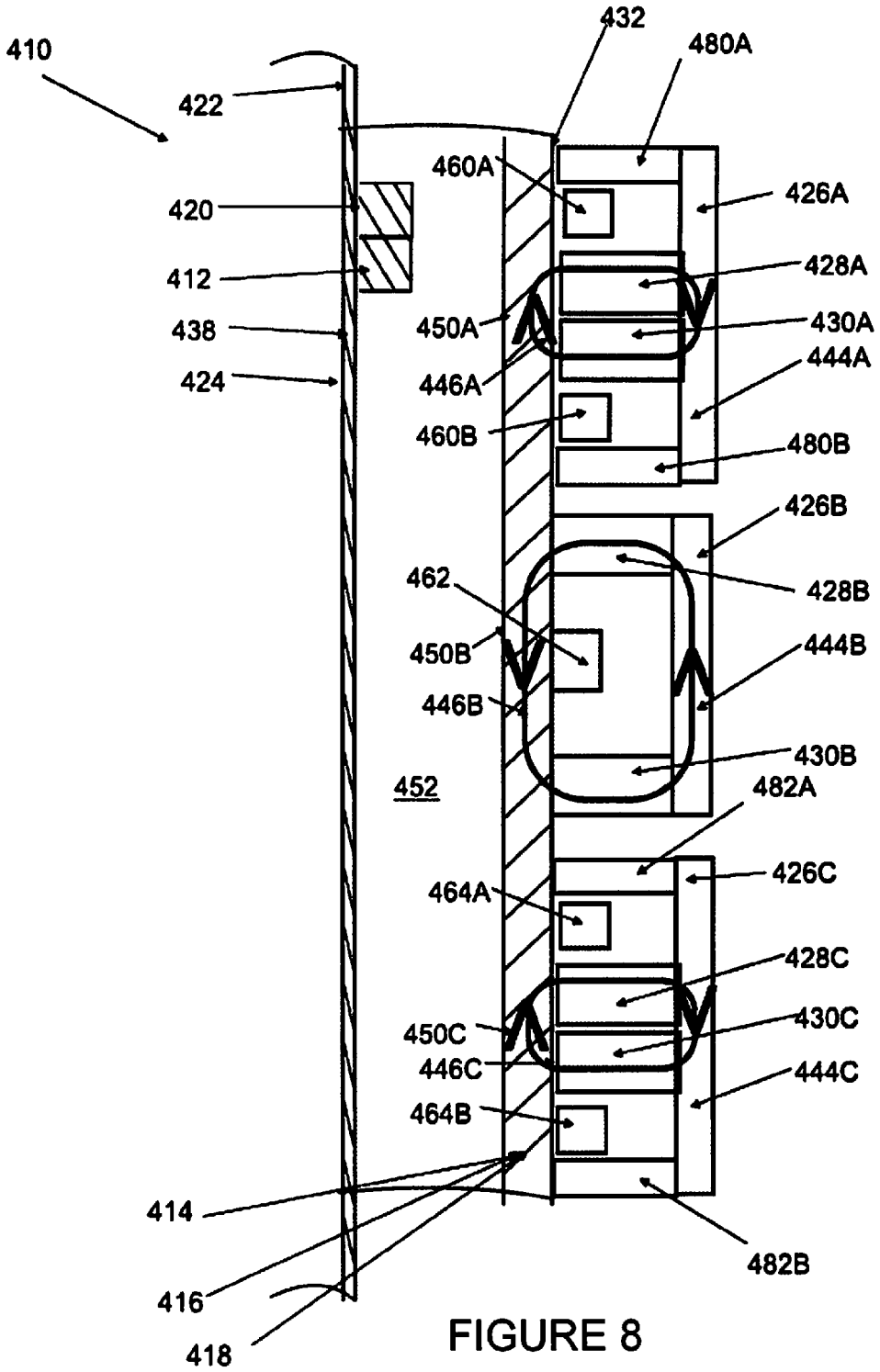
FIG. 8 is a half section through an apparatus for detecting a mass of material within a tubular according to a fourth embodiment of the present invention.

Reference is now made to FIG. 8, a section through an apparatus 410, for detecting a mass of material within a tubular 414 having a tubular wall 416 according to a fourth embodiment of the present invention. The apparatus 410 of this fourth embodiment is very similar to the apparatus of 110 of the first embodiment.

Common features between the first and fourth embodiment have been given the same reference numeral in the fourth embodiment drawings incremented by 400.

The essential difference between the first embodiment apparatus 110 and the fourth embodiment apparatus 410 is the arrangement of sense coils 460, 464 and the addition of further primary magnetic field sources 426. The arrangement will now be described.

There are three permanent magnets 426A, 426B, 426C in the fourth embodiment. These are arranged in a sequence along the riser outer surface 432. The middle, or second, permanent magnetic source 426B has a similar construction as the permanent magnetic source 126 of the first embodiment with permanent magnets 428B, 430B arranged either side of a drive coil 462. The magnets 428B, 430B are linked by a backing plate providing a magnetic flux path 446B in a circuit arrangement flowing around the drive coil 462. The upper, or first, primary magnetic field source 426A and the lower, or third, primary magnetic field source 426C are arranged slightly differently to the second permanent magnetic source 426B. In the first and third permanent magnetic sources 426A, 426C arrangement the upper permanent magnet 428 and the lower permanent magnet 430 are arranged side by side. In the case of the first primary source 426A, a pair of sense coils 460A, 460B are located either side of the permanent magnets 428A, 430A. The apparatus further includes a first pair of linking plates 480A, 480B linking the first primary magnetic field source backing plate 444A to the riser external surface 432, and a second pair of linking plates 482A, 482B linking the third primary magnetic field source backing plate 444C to the riser external surface 432. The purpose of these pairs of linking plates 480, 482 will be discussed in due course.

The first primary magnetic field source, as shown in FIG. 8, establishes a magnetic flux circuit 446A between the sense coils 460A, 460B and the linking plates 480A, 480B in the section of riser wall 450A immediately adjacent the permanent magnets 428A, 430A. A similar arrangement exists for the third primary magnetic field source 426C.

The purpose of the additional primary magnetic field sources 426A, 426C will now be described in connection with FIG. 9, a partial section through the apparatus of FIG. 8 shown with the drive coil 462 activated. With the drive coil 462 activated, the magnetic flux 446 generated by the drive coil 462 seeks the path of least reluctance from the drive coil 462 to the mass of material 412 which has a higher magnetic permeability than the surrounding environment 452. Due to the low magnetic permeability created in the riser portions 450A,450C by first primary magnetic field source 426A and the third primary magnetic field source 426C, the magnetic flux 446 will in preference flow around the outside of the first primary magnetic field source 426A and the third primary magnetic field source 426C. Particularly the magnetic flux 446 will flow through linking members 480, 482 and their respective backing plates 444A, 444C.

Figure 9:
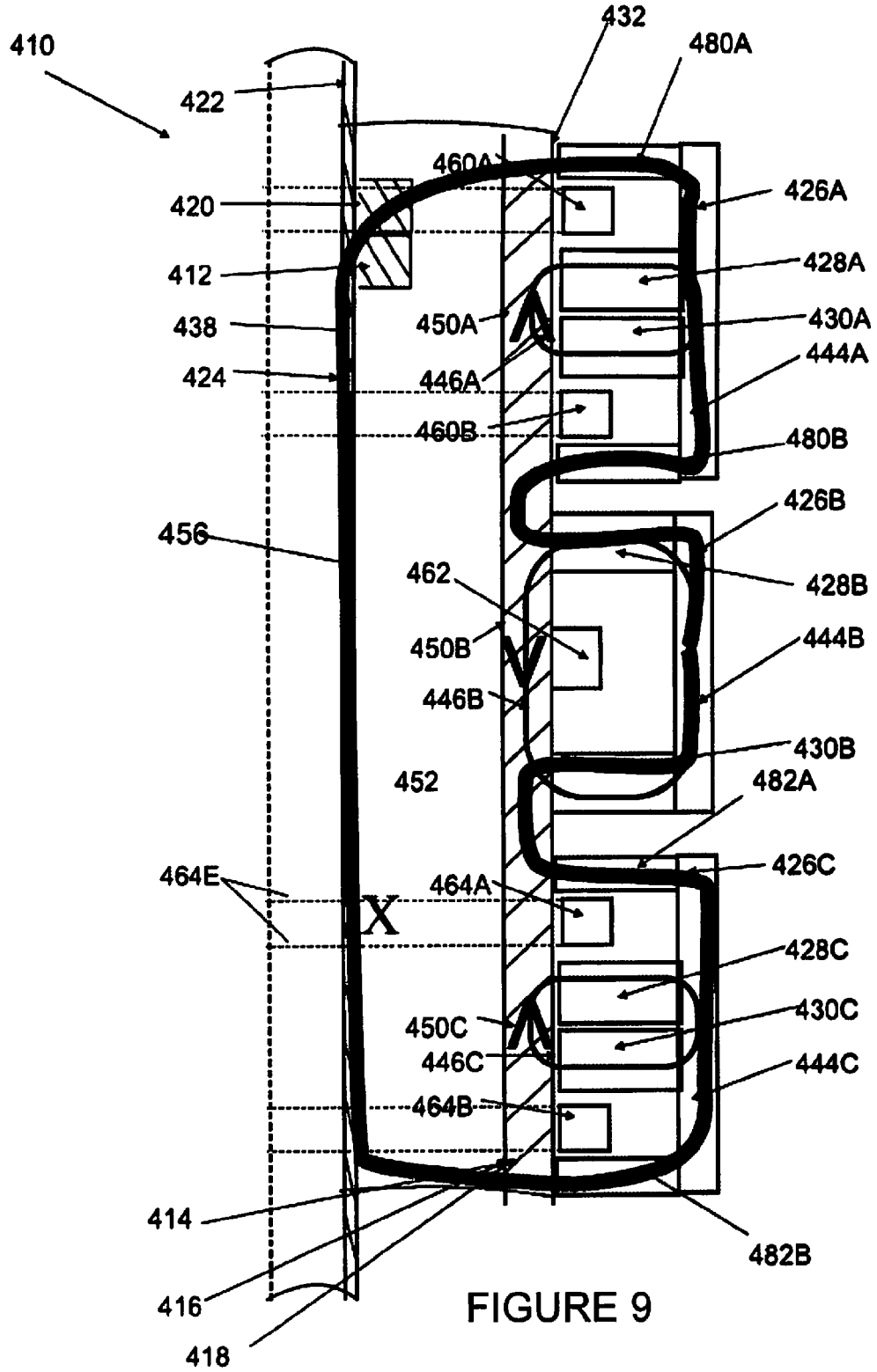

As can be seen from FIG. 9, the magnetic flux 456 generated by the drive coil 462 only flows through each sense coil 460,464 once in the circuit around the apparatus 410 back to the drive coil 462. Taking the upper sense coil 464A in the third primary magnetic field source 426C as an example, the sense coil 464A edges 464E are shown in broken outline. The magnetic flux 456 generated by the drive coil 462 flows through the sense coil 464A at the location marked "X" in the drill pipe 438. The sense coil 462A detects net flux changes perpendicular to its radius. If the flux 456 passes through the drill pipe 438 and comes back through the riser 416, the net flux passing through the coil 462 is close to zero and may be difficult to detect since it will produce no voltage. By providing the first and second primary magnetic sources, a path can be created around the outside of the coils 460, 464 which will give a larger, more easily detectable, flux change through the coils 460, 464.

In alternative embodiments to that shown in FIGS. 8 and 9, the second primary magnetic source 326B may be omitted, the flux path passing around the drive coil 462 through the surrounding environment.

Figure 10:
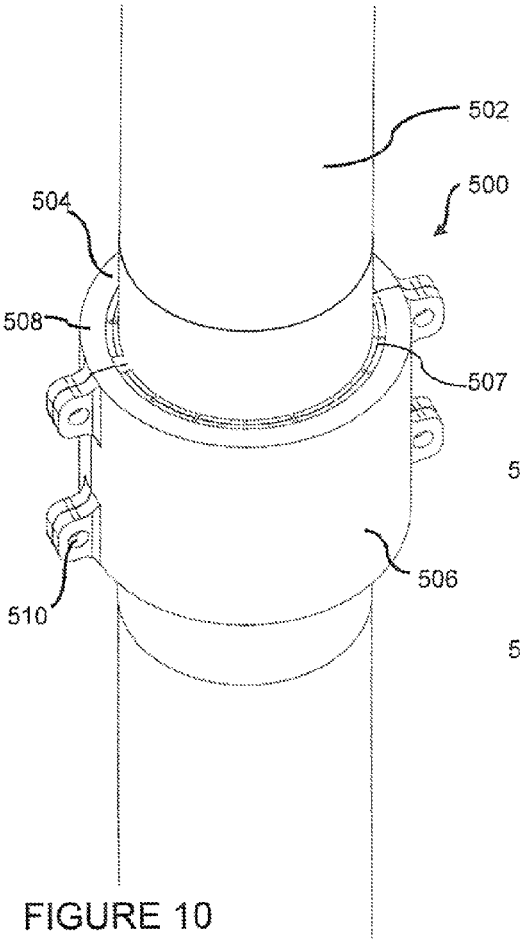
FIG. 10 represents an apparatus according to an embodiment of the present invention, which has been retrofitted into an existing riser. The apparatus comprises a split housing and can be opened and closed.

FIG. 10 shows an apparatus 500 according to the present invention, which has been retrofitted onto an existing riser 502, without interfering with the normal function of the riser 502. This has been accomplished due to the fact that the apparatus 500 can be opened and closed, because it is mounted within a split housing 504, which comprises two halves 506, 508 which function as the permanent magnets 507 back irons and there are drive and sense coils (not visible) wholly contained in each half of the housing. Each half housing comprises flanges 510 so that they can be fitted against each other around the riser 502 and fastened using bolts, washers and nuts (not shown).

Figure 11A:
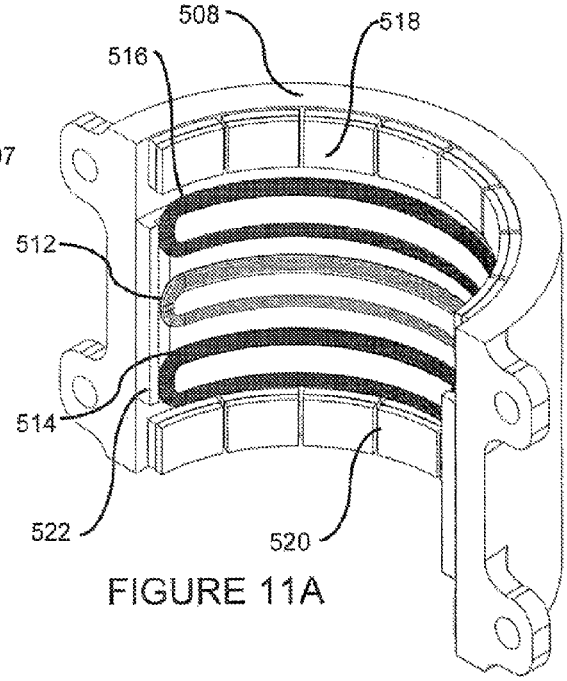
FIG. 11A represents one half of the apparatus shown in FIG. 10 where the interior can be seen.

FIG. 11A shows the internal arrangement of one halve of the apparatus shown in FIG. 10. In the interior part of one of the halves 508 of the apparatus there are a drive coil 512 and two sensing coils 514, 516 located at each side of the drive coil 512. Each of the drive and sense coils 512, 514, 516 defines a closed area on the riser wall when they are mounted onto it, so that they can create/sense magnetic flux to/from the interior of the riser. The fact that the coils do not need to surround the riser completely enables an easier retrofitting of the apparatus onto an existing riser, without having to resort to coils formed from multiple sections interconnected to each other.

The apparatus also comprises two sets of permanent magnets 518, 520 in each half. Each halve housing 508 serves as an element of elevated magnetic permeability to channel the magnetic flux between their respective sets of permanent magnets 518, 520 at the exterior of the riser.

In each halve of the apparatus there is also a coil back iron 522 which is an element used to channel the magnetic flux between the drive and sensing coils at the outside of the riser.

Figure 11B:
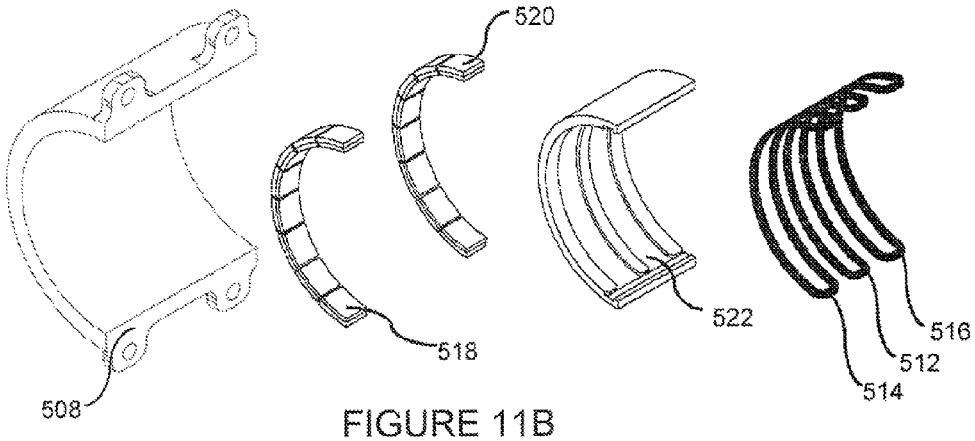
FIG. 11B represents an exploded drawing of the half apparatus shown in FIG. 11A.

FIG. 11B shows an exploded view of the elements that form the half apparatus shown in FIG. 11B. In other embodiments, the other halve of the apparatus may contain other functions, such as a housing for the electronics, a clamp for clamping the riser, an external clamp for other hydraulic lines, etc. or any combination of features.

Figure 12A:
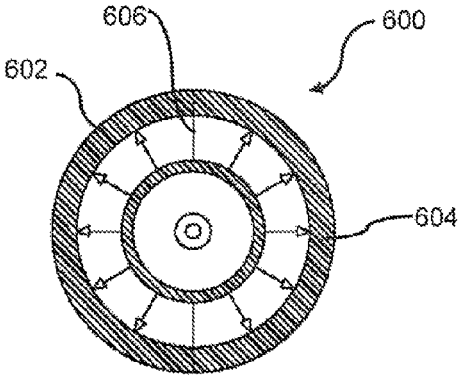
FIG. 12A is a cross-sectional schematic view of an apparatus comprising two sets of drive and sensing coils which cooperatively define a circumference.

FIG. 12A is a cross-sectional schematic view of an apparatus 600 like the one shown in FIG. 10. In FIG. 12A can be seen that the apparatus comprises two separate sets of drive and sensing coils 602, 604 arranged so that the sets cooperatively form a circumference. This arrangement enables an easy opening and closing of the apparatus 600 along the interface 606 so that it can be retrofitted onto existing tubulars without interfering the operations carried out within the tubulars.

Figure 12B:
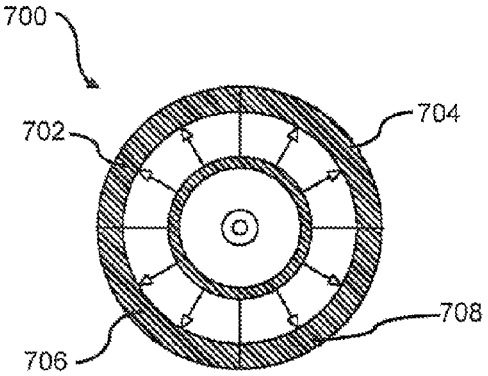
FIG. 12B represents is a cross-sectional schematic view of an apparatus comprising four sets of drive and sensing coils which cooperatively define a circumference.

FIG. 12B shows another apparatus 700 which comprises four sets of drive and sensing coils 702, 704, 706, 708. The four sets 702, 704, 706, 708 cooperatively define a circumference so that they can be retrofitted around a tubular.

Other apparatus with more than four sets of drive/sensing coils can be made without departing from the principles of the invention. By having multiple sets of drive and sensing coils which define a circumference around a riser, it is possible to measure and detect if the drill pipe is or is not offset from the centre of the riser and to which side it is offset and by how much.

Figure 12C:
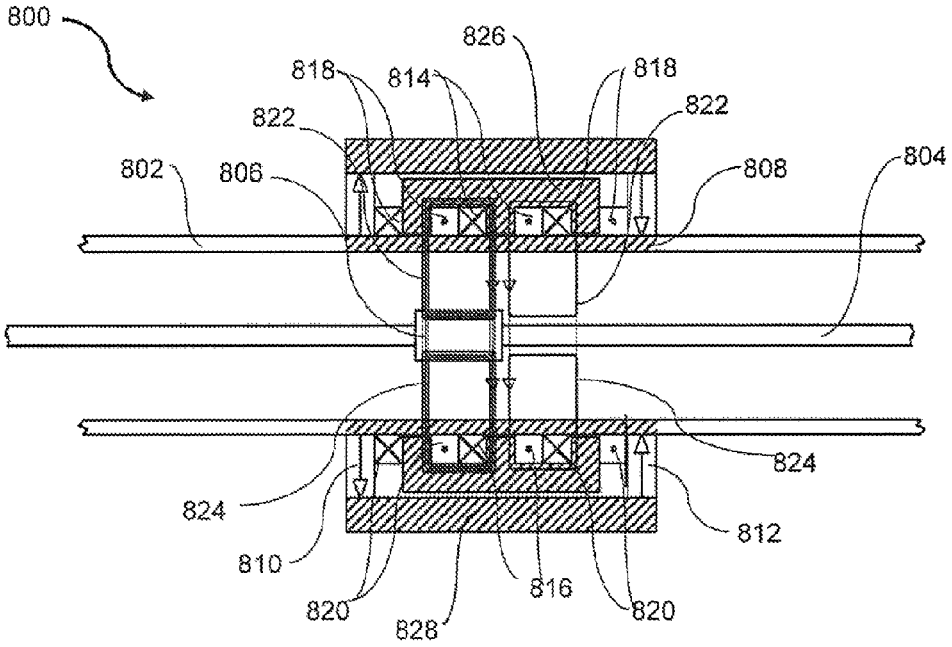
FIG. 12C is a side sectional schematic view of the apparatus shown in FIG. 12B.

FIG. 12C shows a schematic side sectional view of an apparatus 800 with multiple sets of drive/sensing coils which define a circumference. The apparatus 800 is mounted onto a riser 802 which contains a drill string 804. The drill string comprises a joint 806. The portion of the riser 808 covered by the apparatus 800 is magnetically saturated, as indicated by the dashed area. The apparatus comprises two sets of permanent magnets 810, 812 and diametrically opposed drive 814, 816 and sensing 818, 820 coils. The diagram shows how the drive and sense coils can be wired.

In this embodiment, the sets of diametrically opposing drive 814, 816 and sense 818, 820 coils are wound or connected so that the magnetic flux 822 created by each drive coil couples negatively in the apparatus centre with the magnetic flux 824 created by the diametrically opposed drive coil, as it is indicated by arrows. This arrangement directs the magnetic flux in a path perpendicular to the riser between diametrically opposed pickup/drive coils via the drill pipe/tool joint. The net magnetic flux coupling is therefore higher without a tool joint in the magnetic flux path than with a tool joint in the magnetic flux path. Therefore, if the diametrically opposed drive coils are connected in series, the apparatus 800 could sense tool joints using higher voltages and lower currents for generating the drive signal.

Element 826 is the coils back iron, which channels the magnetic flux of the coils 814, 816 outside the tubular and element 828 is the permanent magnet back iron, which channels the magnetic flux created by the permanent magnets 810, 812 outside the tubular.

However, in other embodiments (not shown) the coil back iron (522 in FIG. 11B and 826 in FIG. 12 C) can be used as part of the magnetic circuit that is used to saturate the riser. In this case the saturating structure formed by the PMs and PM back iron is not required. Also in this case there will not be a requirement for an air-gap between the coil back iron and the riser.

FIGS. 13A to 13D show different possibilities of configuring and connecting apparatus according to embodiments of the present invention.

Figure 13A:
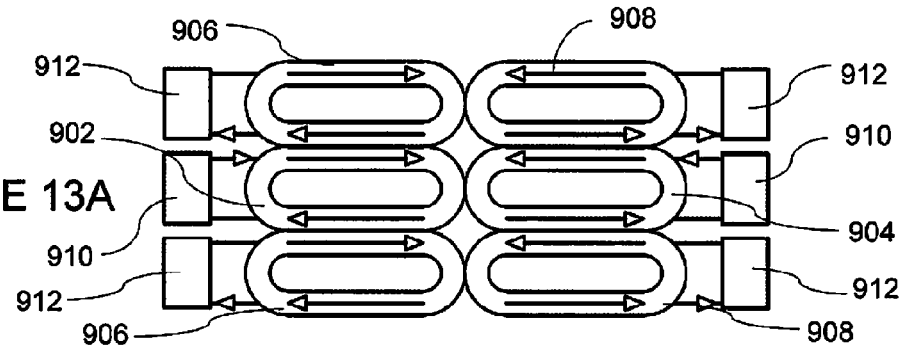
FIGS. 13A to 13 D are schematic representations of different ways of connecting drive and sensing coils in embodiments which comprise a plurality of drive and sensing coils.

FIG. 13A shows a schematic of an apparatus which comprises diametrically opposed drive coils 902, 904 and two sets of diametrically opposed sense coils 906, 908 located at each side of the drive coils 902, 904. In this embodiment, each drive coil 902, 904 is connected individually to a drive electronic system 910 and the drive coils 902, 904 are not connected between them. Likewise, each sense coil is connected individually to a sense electronics system 912 and the sense coils are not connected between them. This configuration is most suited for modular and/or redundant systems, which can function as a back-up, in the event of a failure of one of the modules/redundant systems.

Figure 13B:
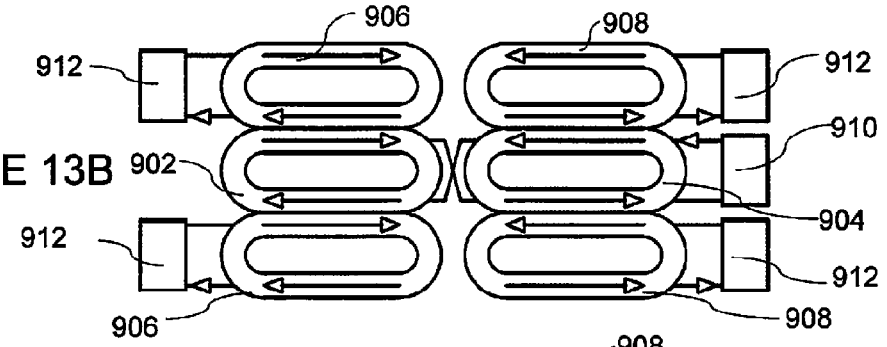

FIG. 13B shows a schematic of another apparatus which comprises diametrically opposed drive coils 902, 904 and two sets of diametrically opposed sense coils 906, 908 located at each side of the drive coils 902, 904. In this embodiment, the drive coils 902, 904 are connected between them and the pair are connected to a single drive electronic system 910 whereas the sense coils arrangement and connections are as in the precedent example of FIG. 13A. This configuration is also suitable for sensing tool joints using higher voltages and lower currents for generating the drive signal, as explained before.

Figure 13C:
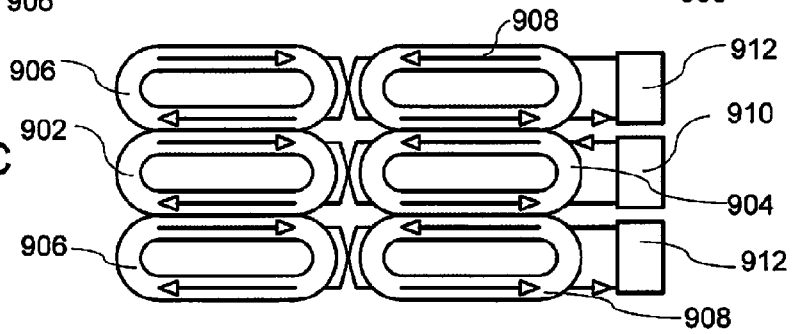

FIG. 13C shows a schematic of another apparatus which comprises diametrically opposed drive coils 902, 904 and two sets of diametrically opposed sense coils 906, 908 located at each side of the drive coils 902, 904. In this embodiment, the drive coils 902, 904 are connected between them and the pair are connected to a single drive electronic system 910, as in the precedent example, whereas the diametrically opposed sense coils are also connected between them and connected to a single sense electronics system 912 for each pair of opposing sensing coils 906, 908. This configuration is most suited for obtaining sense signals at higher voltages.

Figure 13D:
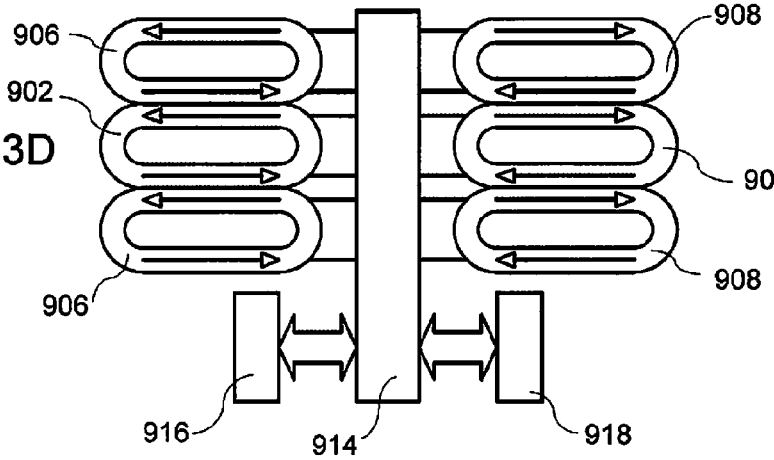

FIG. 13D shows a schematic of another apparatus which comprises diametrically opposed drive coils 902, 904 and two sets of diametrically opposed sense coils 906, 908 located at each side of the drive coils 902, 904. In this embodiment, the drive coils 902, 904 and the sense coils are all connected to a configurable switching network 914 and the configurable switching network 914 is connected to a drive electronics system for multiple coils 916 and to a sense electronics system for multiple coils 918. In this embodiment all coils can function as drive or as sensing coils, thus providing more functional flexibility. This configuration allows measurement of all coils self-inductances and any combination of coil mutual inductances. Additionally this configuration allows using common drive and/or sense electronics for multiple coils.

In the embodiments shown in FIGS. 13A to 13D, the sense and drive electronic systems can be connected either to a master control system or to distributed control systems which are connected using a communications method.

In addition to the connection possibilities described before, there may be other configurations and connection possibilities within the scope of the present invention and these have been presented by way of example only. Another possibility is to connect the drive and/or sense coils to a system that can measure each coil auto-induction and/or the induction produced by adjacent coils. Therefore drive/sensing electronics can be connected to any coil in the system such that the self-inductance of all coils can be measured and any mutual inductance combination between all coils can be measured to determine information on tool joint axial and radial location and drill pipe radial location within the measurement range of the apparatus. Any sense coil could equally perform the function of a drive coil and any drive coil could equally perform the function of a sense coil. The connectivity of the sense/drive coils between the drive/sense electronics can be either hard wired or configurable by means of a switching network. The switching network can be a mechanical, electro-mechanical or solid state implementation.

Various modifications and improvements may be made to the above described embodiments without departing from the scope of the invention. For example, although the drive coil is shown in some embodiments as being centrally located within the apparatus, the drive coil could be in any position along the saturated wall portion. Indeed, a number of the coils could swap from being sense coils to being drive coils as required.

Furthermore, although only one primary magnetic source is shown in some of the described embodiments, multiple primary magnetic sources could be used, each primary magnetic source reducing the permeability of a different section of the tubular wall for a secondary magnetic source to establish a magnetic field within the tubular wall through bore.

The invention claimed is:

1. An apparatus for detecting a mass of material that has a magnetic permeability different to that of the surrounding environment within a tubular, the apparatus comprising:

at least one primary magnetic field source adapted to be mounted to an external surface of a tubular wall and establish a magnetic field in a portion of the tubular wall, the magnetic field, in use, reducing the magnetic permeability of the tubular wall portion;

at least one secondary magnetic field source adapted to be located externally of the tubular wall portion, each of the at least one secondary magnetic field source being adapted to establish a magnetic field within a throughbore defined by the tubular wall; and at least one sense coil, each of the at least one sense coil being adapted to measure a rate of change of the magnetic field within the tubular throughbore.

2. An apparatus according to claim 1 comprising a plurality of sense coils.

3. An apparatus according to claim 1 wherein the at least one primary magnetic field source is adapted to establish a magnetic field within the throughbore defined by the tubular wall.

4. An apparatus according to claim 1 further comprising a plurality of secondary magnetic field sources, each source being adapted to establish a magnetic field within the throughbore defined by the tubular wall.

5. An apparatus according to claim 1 wherein the at least one primary magnetic field source and/or the at least one secondary magnetic field source comprise at least one permanent magnet.

6. An apparatus according to claim 1 wherein the at least one primary magnetic field source and/or the at least one secondary magnetic field source comprise at least one temporary magnet.

7. An apparatus according to claim 1 wherein the at least one sense coil is arranged adjacent the tubular wall portion.

8. An apparatus according to claim 1 wherein the at least one sense coil is arranged around part of the circumference of the tubular wall portion.

9. An apparatus according to claim 1 wherein the apparatus comprises a plurality of primary magnetic field sources and wherein each primary magnetic field source is adapted to establish a magnetic circuit within a different portion of the tubular wall.

10. An apparatus according to claim 1 being configured to measure the self-inductance of a drive coil.

11. An apparatus according to claim 1 comprising at least one element of elevated magnetic permeability configured to channel the magnetic flux created by each of the at least one primary magnetic field source at the outer side of the/each primary magnetic field source.

12. An apparatus according to claim 1 comprising at least one element of elevated magnetic permeability configured to channel the magnetic flux created by each of the at least one secondary magnetic field source at the outer side of each of the at least one secondary magnetic field source.

13. A method of detecting a mass of material within a tubular, the method comprising the steps of:

reducing a magnetic permeability of a portion of a tubular wall;

establishing a magnetic field within a tubular throughbore through said portion of the tubular wall; and measuring a rate of change of the magnetic field associated with the presence of a mass of material within the tubular.

14. A method according to claim 13 comprising the step of varying the magnetic field within the tubular to vary the magnetic field associated with the presence of the mass of material within the tubular.

15. A method according to claim 13 comprising the step of measuring the rate of change of magnetic field within the tubular at multiple separate locations.

16. An apparatus for detecting a mass of material that has a magnetic permeability different to that of the surrounding environment within a tubular, the apparatus comprising:

at least one primary magnetic field source adapted to be mounted to an external surface of a tubular wall and establish a magnetic field in a portion of the tubular wall, the magnetic field, in use, reducing the magnetic permeability of the tubular wall portion;

at least one secondary magnetic field source adapted to be located externally of the tubular wall portion, the at least one secondary magnetic field source being adapted to establish a variable magnetic field within a throughbore defined by the tubular wall portion; and a plurality of sense coils, each of the plurality of sense coils being adapted to measure a rate of change of the magnetic field within the tubular throughbore.

17. An apparatus according to claim 16 wherein the plurality of sense coils cooperatively define at least one circumference.

18. An apparatus according to claim 16 wherein each of the plurality of sense coils is arranged such that it defines a closed area on the tubular wall.

19. An apparatus according to claim 16 wherein the at least one secondary magnetic source is a plurality of drive coils.

20. An apparatus according to claim 16 comprising drive electronics to control at least one of a plurality of drive coils.

21. An apparatus according to claim 16 comprising sensing electronics to control the plurality of sense coils.

22. An apparatus according to claim 16 wherein the plurality of sense coils are individually connected to control electronic circuits.

23. An apparatus comprising:

a primary magnetic field source to establish a magnetic field in a portion of a tubular wall to reduce a magnetic permeability of a tubular wall;

a secondary magnetic field source to establish a magnetic field within a throughbore defined by the tubular wall; and a sense coil to measure a rate of change of the magnetic field within the throughbore.

* * * * *